US009341130B2

(12) United States Patent
Makabe

(10) Patent No.: US 9,341,130 B2
(45) Date of Patent: May 17, 2016

(54) VEHICLE CONTROL DEVICE

(71) Applicant: HONDA MOTOR CO., LTD., Tokyo (JP)

(72) Inventor: Takumi Makabe, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 297 days.

(21) Appl. No.: 14/162,417

(22) Filed: Jan. 23, 2014

(65) Prior Publication Data

US 2014/0288806 A1 Sep. 25, 2014

(30) Foreign Application Priority Data

Mar. 22, 2013 (JP) ..... 2013-060802

(51) Int. Cl.

| | |
|---|---|
| ***F02D 17/02*** | (2006.01) |
| ***F02D 41/04*** | (2006.01) |
| ***F02D 41/20*** | (2006.01) |
| ***F02D 41/30*** | (2006.01) |

(52) U.S. Cl.

CPC ..... *F02D 41/042* (2013.01); *F02D 17/02* (2013.01); *F02D 41/20* (2013.01); *F02D 41/3082* (2013.01); *F02D 2041/2003* (2013.01); *F02D 2041/2051* (2013.01); *F02D 2041/2058* (2013.01); *F02D 2200/604* (2013.01)

(58) Field of Classification Search

CPC ... F02D 17/02; F02D 17/04; F02D 2200/604; F01M 1/24; F01M 1/26; F01M 1/27; F01M 1/28

USPC ..... 701/112; 123/198 DB, 198 DC

See application file for complete search history.

(56) References Cited

U.S. PATENT DOCUMENTS

| | | | | | |
|---|---|---|---|---|---|
| 4,712,521 | A | * | 12/1987 | Campen | F02B 63/02 123/198 DC |
| 5,190,148 | A | * | 3/1993 | Williams | H01H 27/06 123/198 DC |
| 5,305,791 | A | * | 4/1994 | Kowalchuk | F02D 17/04 137/554 |
| 5,572,969 | A | * | 11/1996 | Coughlin | H01H 35/02 123/198 DC |
| 5,878,709 | A | * | 3/1999 | Andersson | F02D 41/042 123/198 DC |

FOREIGN PATENT DOCUMENTS

JP 4716429 B2 7/2011

* cited by examiner

*Primary Examiner* — Erick Solis

(74) *Attorney, Agent, or Firm* — Birch, Stewart, Kolasch & Birch, LLP

(57) ABSTRACT

A vehicle control device for controlling an engine and an electric pump includes a relay having a contact part for connecting and disconnecting a power source to the electric pump, an engine stop instruction switch provided between the power source and a coil part of the relay for connecting and disconnecting the power source to and from the coil part. A control unit for controlling the engine and the relay and determining whether or not operation of the engine stop instruction switch is made. The control unit includes a port to which the coil part and a drive part are connected for switching current application of the coil part, a detection part for detecting a current flowing to the port, and a determiner for determining whether or not the operation of the engine stop instruction switch is made based on a detection result of the detection part.

20 Claims, 4 Drawing Sheets

VEHICLE CONTROL DEVICE

CROSS-REFERENCE TO RELATED APPLICATIONS

The present application claims priority under 35 USC 119 to Japanese Patent Application No. 2013-060802 filed Mar. 22, 2013 the entire contents of which are hereby incorporated by reference.

BACKGROUND OF THE INVENTION

1. Field of the Invention

The present invention relates to vehicle control devices and particularly to a vehicle control device including an engine stop instruction switch.

2. Description of Background Art

An engine stop instruction switch is provided in vehicles typified by two-wheeled vehicles. See, for example, Japanese Patent No. Hei 4716429. A control unit of the vehicle stops the engine when the operation to the engine stop instruction switch is made. To determine whether or not the operation to the engine stop instruction switch is made, the control unit is provided with a dedicated port connected to the engine stop instruction switch.

Because of diversification of the functions of the control unit of the vehicle, the number of external devices connected to the control unit increases. However, there is a limit to the number of ports of the control unit and it is difficult to achieve an increase in the number of functions due to insufficiency in the number of ports in some cases.

SUMMARY AND OBJECTS OF THE INVENTION

An object of an embodiment of the present invention is to eliminate the need for the dedicated port of the engine stop instruction switch to avoid insufficiency in the number of ports.

According to an embodiment of the present invention, a vehicle control device (A) is provided that controls a vehicle (100) includes an engine (E) and an electric pump (1). The vehicle control device (A) includes a relay (2) having a contact part (2*a*) that connects and disconnects a power source (V) to and from the electric pump (1), an engine stop instruction switch (4) that is provided between the power source (V) and a coil part (2*b*) of the relay (2) and connects and disconnects the power source (V) to and from the coil part (2*b*). A control unit (3) controls the engine (E) and the relay (2) and determines whether or not the operation of the engine stop instruction switch (4) is made. The control unit (3) includes a port (3*c*) to which the coil part (2*b*) is connected with a drive part (34) that is connected to the port (3*c*) and switches the current application of the coil part (2*b*). A detection part (35) detects a current flowing to the port (3*c*). A determiner (31) determines whether or not the operation of the engine stop instruction switch (4) is made based on a detection result of the detection part (35).

According to an embodiment of the present invention, the detection part (35) may include an amplifier circuit (35*b*) that converts the current to a voltage to amplify the voltage and output the amplified voltage.

According to an embodiment of the present invention, a fuel injection device (5) and an ignition coil (6) of the engine (E) may be connected on a power supply line (L) between the power source (V) and the coil part (2*b*) and on the upstream side of the engine stop instruction switch (4). The control unit (3) may carry out fault diagnosis of the fuel injection device (5) when the vehicle (100) is powered on.

According to an embodiment of the present invention, the electric pump (1) may be a fuel pump that supplies fuel from a fuel tank (105) to the engine (E).

According to an embodiment of the present invention, the detection part (35) may include a shunt resistor (35*a*) that is connected to the drive part (34) and through which a current flowing through the coil part (2*b*) flows. In addition, the amplifier circuit (35*b*) may be a differential amplifier circuit that includes an operational amplifier (OP) for amplifying the voltage across the shunt resistor (35*a*).

According to an embodiment of the present invention, the drive part (34) may be a switching element and the shunt resistor (35*a*) may be provided between the switching element (34) and GND.

According to an embodiment of the present invention, the determiner (31) may compare a voltage output from the detection part (35) with a threshold to determine whether or not the operation of the engine stop instruction switch (4) is made.

According to an embodiment of the present invention, by determining whether or not the operation to the engine stop instruction switch is made by utilizing the port to which the drive part is connected, the need for a dedicated port of the engine stop instruction switch can be eliminated and insufficiency in ports can be avoided.

According to an embodiment of the present invention, due to the provision of the amplifier circuit, it becomes easy to determine whether or not the operation of the engine stop instruction switch is made even when the current flowing to the port is weak.

According to an embodiment of the present invention, fault diagnosis of the fuel injection device and the ignition coil can be carried out at the initial stage without being affected by the state of the engine stop instruction switch.

According to an embodiment of the present invention, by determining whether or not the operation of the engine stop instruction switch is made by utilizing the relay for the fuel pump, which is always set to the on-state during the period when the engine is driven, the determination of whether or not the operation is made is made more surely.

According to an embodiment of the present invention, the detection part can be formed with a comparatively-simple circuit configuration.

According to an embodiment of the present invention, the detection part can be formed with a comparatively-simple circuit configuration.

According to an embodiment of the present invention, the operation determination can be carried out comparatively easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
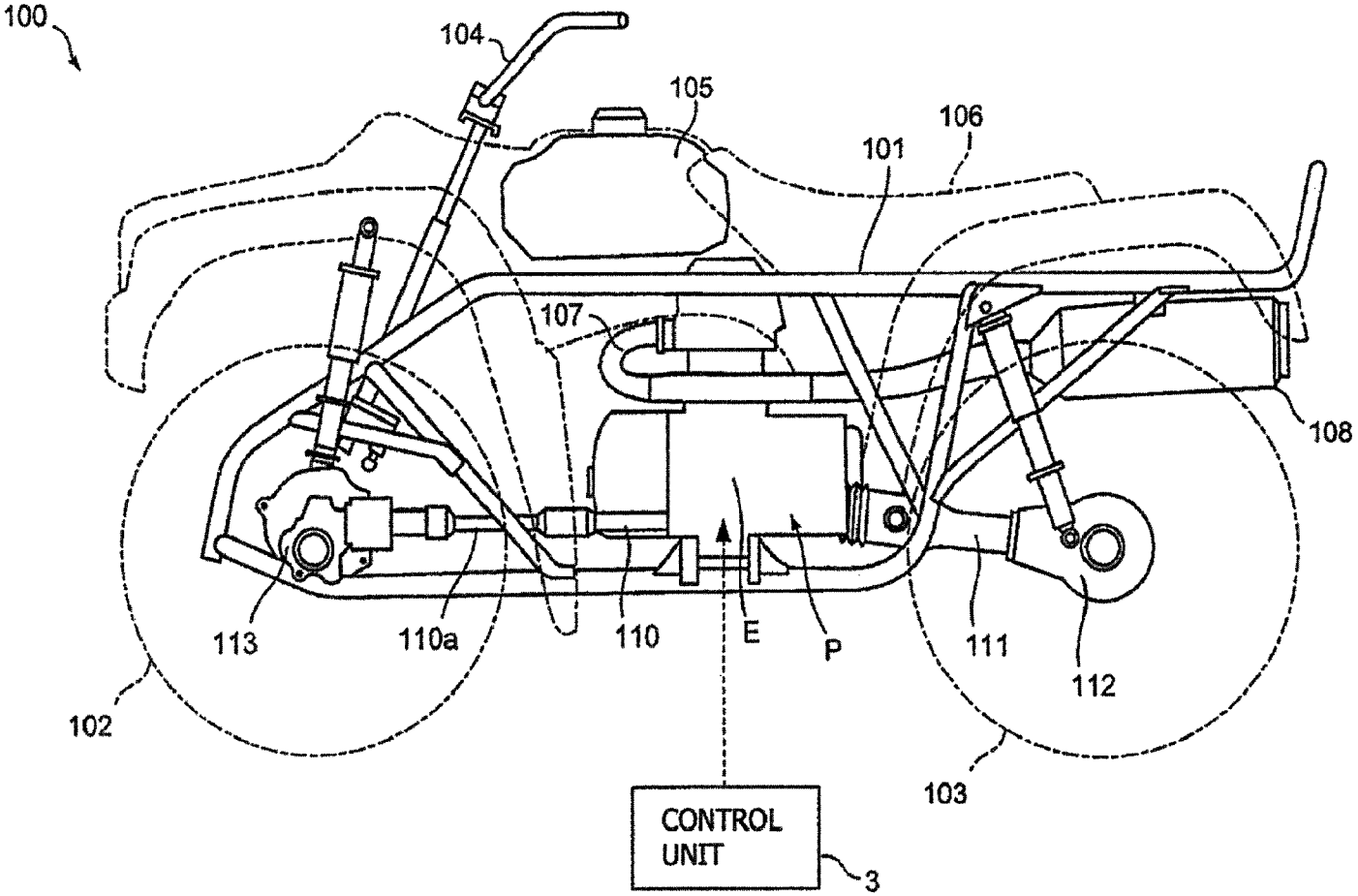
FIG. 1 is a schematic side view of a vehicle as an application example of the present invention.
Figure 2:
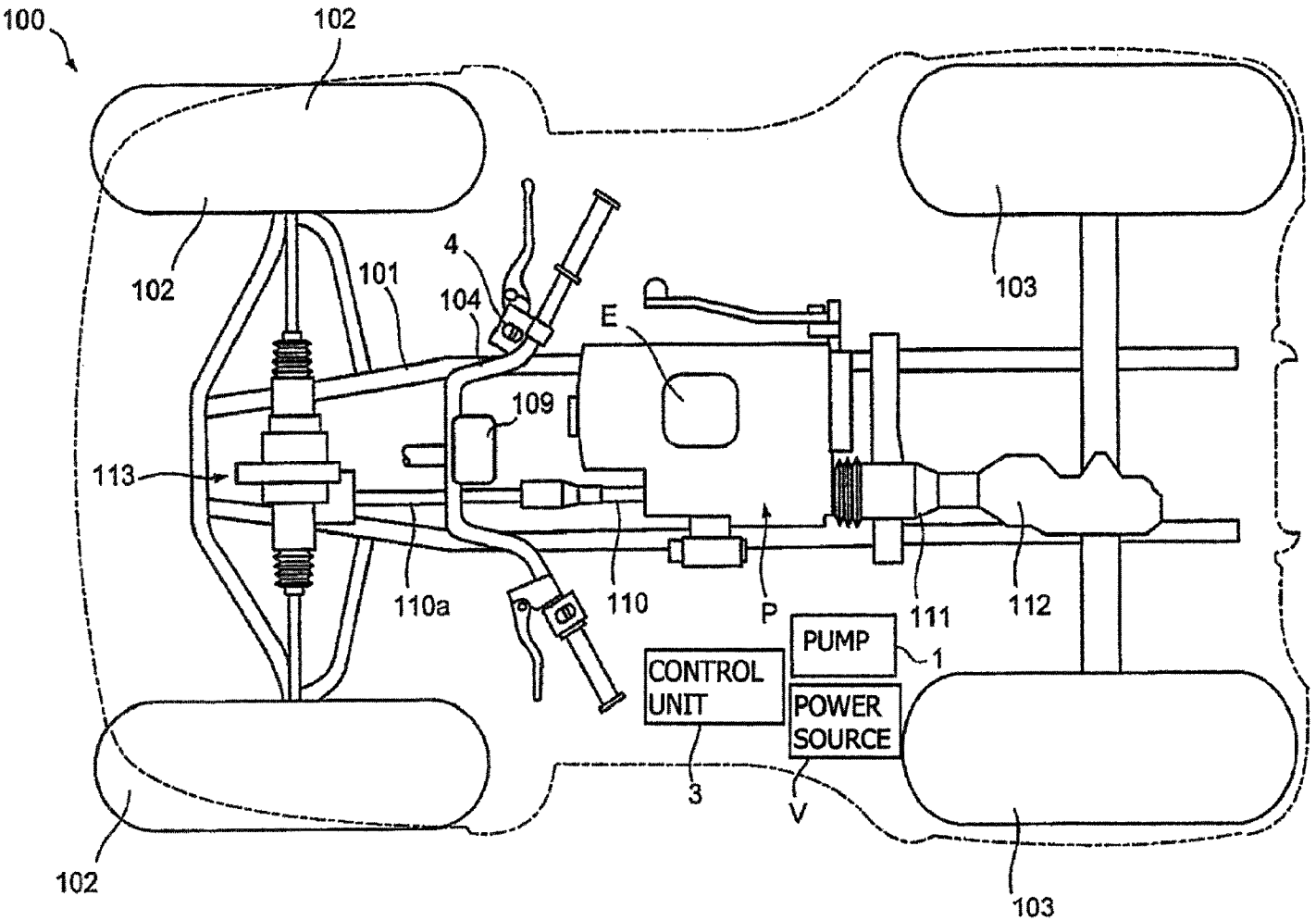
FIG. 2 is a schematic plan view of the vehicle as the application example of the present invention.

FIGS. 1 and 2 are a schematic side view and a schematic plan view of a vehicle 100 as an application example of the present invention. The vehicle 100 is a vehicle for traveling on an irregular ground surface. More particularly, a saddle-type four-wheeled buggy car. However, the present invention is not limited to the four-wheeled buggy car and can be applied to various kinds of vehicles.

In the vehicle 100, front wheels 102 as a pair of left and right wheels serving as both steered wheels and drive wheels are suspended at a front part of a vehicle body frame 101 made by welding pipes and so forth. A pair of left and right drive rear wheels 103 are suspended at a rear part of the vehicle body frame 101.

A handlebar 104 to steer the front wheels 102 is provided at a front end of the vehicle body frame 101. A meter unit 109 is disposed at a center part of the handlebar 104 for allowing a driver to be informed of various operational information. Furthermore, an engine stop instruction switch 4 that is operable by the driver is disposed on the handlebar 104. The driver operates the engine stop instruction switch 4 to thereby forcibly stop the engine of the vehicle 100.

A fuel tank 105 is disposed at an intermediate part of the vehicle body frame 101 in the front-rear direction with a straddle-type seat 106 being disposed rearwardly of the fuel tank 105 and at an upper part of the vehicle body frame 101. Below the seat 106, a power unit P that carries out rotary driving of a driveshaft 110 is mounted. The power unit P has an engine E driven by fuel supplied from the fuel tank 105 and includes a transmission that reduces the output of the engine E, a clutch that connects and disconnects a drive train between the engine E and the transmission, an electric generator driven by the engine E, and so forth. An exhaust gas of the engine E of the power unit P is discharged from a muffler 108 to the atmospheric air via an exhaust pipe 107.

The driving force of the driveshaft 110 is transmitted to a final reduction gear 112 via a propeller shaft housed in a swing arm 111, so that the rear wheels 103 are driven. It is also possible to provide a differential gear in the final reduction gear 112.

The driving force of the driveshaft 110 is also transmitted to a final reduction gear 113 via a propeller shaft 110*a*, so that the front wheels 102 are driven. When the driveshaft 110 and the propeller shaft 110*a* are connected by a constant velocity joint, full-time four-wheel driving is obtained. When they are connected via a clutch, two-wheel driving and four-wheel driving can be selected.

The final reduction gear 113 can include a differential gear of the front wheels 102 and a differential lock for locking the differential gear. An operation button for allowing the driver to instruct whether or not to actuate the differential lock may be provided on the handlebar 104.

The vehicle 100 includes a control unit 3. The control unit 3 is an electric circuit responsible for engine control of the power unit P and control of the whole of the vehicle 100.

Figure 3:
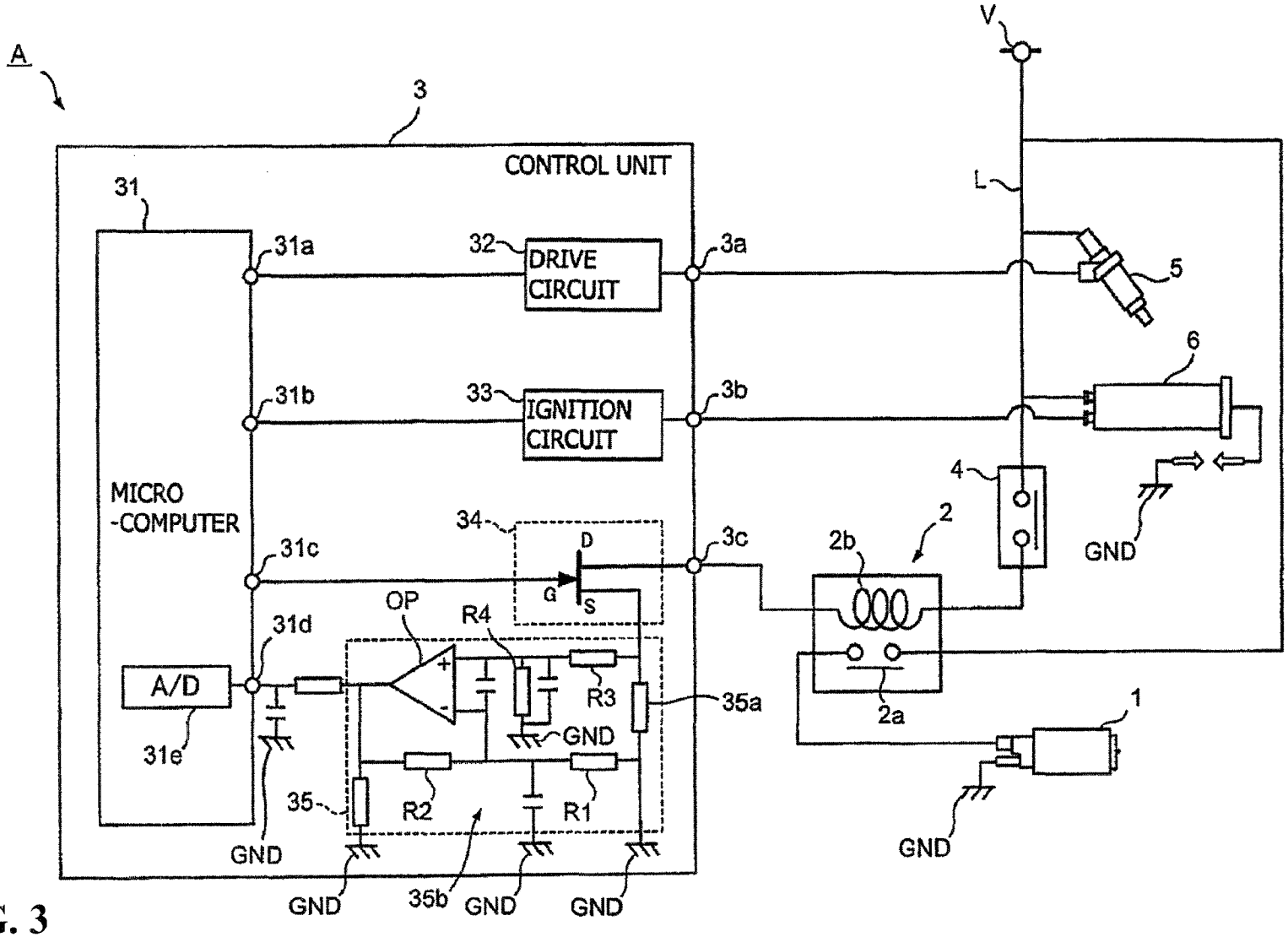
FIG. 3 is a block diagram of a vehicle control device as one embodiment of the present invention.

FIG. 3 is a block diagram of a vehicle control device A as one embodiment of the present invention. In the case of the present embodiment, the control device A is composed mainly of the control unit 3. FIG. 3 shows only a configuration relating to the engine stop instruction switch 4 and a configuration relating to a configuration to be described below.

The vehicle 100 includes an electric pump 1, a relay 2, and a fuel injection device 5 and an ignition coil 6 that are provided for the engine E. They are connected to a common power supply line L and receive power supply from a power source V such as a power source circuit connected to a battery. In the case of the present embodiment, the electric pump 1 is a fuel pump that supplies a fuel from the fuel tank 105 to the fuel injection device 5 of the engine E.

The relay 2 is a relay that allows and stops the power supply to the electric pump 1 and includes a contact part 2*a* and a coil part 2*b* that opens and closes the contact part 2*a*. One terminal of the contact part 2*a* is connected to the power supply line L and the other terminal is connected to a motor possessed by the electric pump 1. One end of the coil part 2*b* is connected to one terminal of a contact part of the engine stop instruction switch 4 via the power supply line L and the other end is connected to an input/output port 3*c* of the control unit 3. Based on the output state of the input/output port 3*c*, a state can be switched to the state in which a current flows through the coil part 2*b* and the contact part 2*a* is closed (conductive state) and a state in which the current necessary to close the contact part 2*a* does not flow through the coil part 2*b* and the contact part 2*a* is opened (blocking state). Therefore, the power source V can be connected and disconnected to and from the electric pump 1 by the contact part 2*a*.

The fuel injection device 5 is an electric actuator that injects the fuel into an intake port (or cylinder) of the engine E and is connected to a port 3*a* of the control unit 3. Based on the output state of the output port 3*a*, the fuel injection device 5 can be driven to inject the fuel.

The ignition coil 6 is an electric actuator that ignites an air-fuel mixture in a combustion chamber of the engine E and is connected to an output port 3*b* of the control unit 3. Based on the output state of the output port 3*b*, the ignition coil 6 can be driven to ignite the air-fuel mixture.

The engine stop instruction switch 4 is provided on the power supply line L, The engine stop instruction switch is set to a state in which its contact part is closed (conductive state) in the normal state, and enters a state in which its contact part is opened (blocking state) when being operated by the driver to instruct a stopping of the engine. If the power source V is deemed as the element of the most upstream side, in the blocking state, the power supply from the power source V to the configuration on the downstream side of the engine stop instruction switch 4 is stopped.

In the case of the present embodiment, the fuel injection device 5 and the ignition coil 6 are connected to the power supply line L on the upstream side of the engine stop instruction switch 4, whereas the coil part 2*b* of the relay 2 is connected to the power supply line L on the downstream side of the engine stop instruction switch 4. Therefore, when an instruction to stop the engine is given, the power supply from the power source V to the electric pump 1 and the relay 2 is stopped whereas the power supply from the power source V to the fuel injection device 5 and the ignition coil 6 is continued.

The control unit 3 is e.g. an ASIC integrated into one chip including a microcomputer 31 and includes the above-described ports 3*a* to 3*c* as ports for input or output to or from external devices. The operation port 3*c* (referred to also as the input/output port 3*c*) is a port serving as both an operation port to drive the coil part 2*b* of the relay 2 and an input port to which the state of the contact part of the engine stop instruction switch 4 is input.

The microcomputer 31 includes a CPU, a storage such as a ROM, an I/O interface, an A/D converter 31*e*, and so forth and runs a program stored in the internal storage or an external storage not shown. The microcomputer 31 includes output ports 31*a* to 31*c* and an input port 31*d*.

A drive circuit 32 to drive the fuel injection device 5 is provided between the output port 3*a* and the output port 31*a* and an ignition circuit 33 is provided between the output port 3*b* and the output port 31*b*. This allows driving control of the fuel injection device 5 and the ignition coil 6 based on the output of the microcomputer 31.

A drive part 34 to switch the current application of the coil part 2*b* of the relay 2 is provided between the input/output port 3*c* and the output port 31*c*. In the case of the present embodiment, the drive part 34 is formed of a switching element and particularly an FET. However, the drive part 34 may be formed of another switching element such as a transistor.

The drain of the drive part 34 is connected to the input/output port 3*c* and the source is grounded via a shunt resistor 35*a*. The gate is connected to the output port 31*c*. Therefore, the drive part 34 is switched on and off by a signal output from the output port 31*c*. When the drive part 34 is in the on-state, a current flows through the coil part 2*b* of the relay 2 and the contact part 2*a* is closed. The current flowing through the coil part 2*b* passes through the shunt resistor 35*a* to flow to the ground (GND). When the drive part 34 is in the off-state, the contact part 2*a* is opened.

A detection part 35 that detects the current flowing to the input/output port 3*c* is provided between the input/output port 3*c* and the input port 31*d*. In the case of the present embodiment, the detection part 35 includes the shunt resistor 35*a* and an amplifier circuit 35*b*. The shunt resistor 35*a* is connected to the drive part 34 and the current flowing through the coil part 2*b* flows through it when the drive part 34 is in the on-state. The amplifier circuit 35*b* converts the current flowing through the shunt resistor 35*a* to a voltage and amplifies it to output the amplified voltage to the input port 31*d*. Due to the provision of the amplifier circuit 35*b*, it is easy to determine whether or not the operation of the engine stop instruction switch 4 is made even when the current flowing through the shunt resistor 35*a* is weak.

In the case of the present embodiment, the amplifier circuit 35*b* is a differential amplifier circuit including an operational amplifier OP and resistors R1 to R4 for amplifying the voltage across the shunt resistor 35*a*. It does not have a special configuration as an amplifier circuit and the detection part 35 can be formed with a comparatively-simple circuit configuration.

The resistor R3 is connected to the non-inverting input of the operational amplifier OP and one end of the shunt resistor 35*a* and the resistor R4 is connected to the non-inverting input of the operational amplifier OP and GND. The resistor R1 is connected to the inverting input of the operational amplifier OP and the other end of the shunt resistor 35*a* and the resistor R2 is connected to the inverting input of the operational amplifier OP and the output of the operational amplifier OP. The output of the operational amplifier OP is connected to the input port 31*d* via a resistor. When the resistance values of the resistors R1 and R3 are set identical (to r1) and the resistance values of the resistors R2 and R4 are set identical (to r2), the gain is r2/r1.

When the engine stop instruction switch 4 is in the conductive state and the contact part 2*a* of the relay 2 is in the closed state, the current flowing from the power source V to the coil part 2*b* flows through the shunt resistor 35*a* and the voltage across it is amplified by the amplifier circuit 35*b* to be measured by the A/D converter 31*e*. On the other hand, when the engine stop instruction switch 4 enters the blocking state, no current flows from the power source V to the coil part 2*b*, so that the voltage measured by the A/D converter 31*e* becomes substantially 0. Thus, the microcomputer 31 can determine whether or not the operation of the engine stop instruction switch 4 is made by monitoring the voltage measured by the A/D converter 31*e*.

As described above, in the present embodiment, the input/output port 3*c* serves as both a port for detecting operation to the engine stop instruction switch 4 and an operation port for control of the relay 2. This eliminates the need for a dedicated port for detecting the operation to the engine stop instruction switch 4 and can avoid the situation in which ports assigned to other functions are insufficient. Furthermore, the work of wiring between the control unit 3 and external devices can be reduced.

The relay 2 to which the engine stop instruction switch 4 is connected may be one for an electric pump other than the fuel pump. However, the fuel pump is always driven during the period when the engine is driven and the relay 2 is always set to the on-state. Thus, by utilizing this to determine whether or not the operation of the engine stop instruction switch 4 is made, whether or not the operation is made can be determined more surely.

Figure 4B:
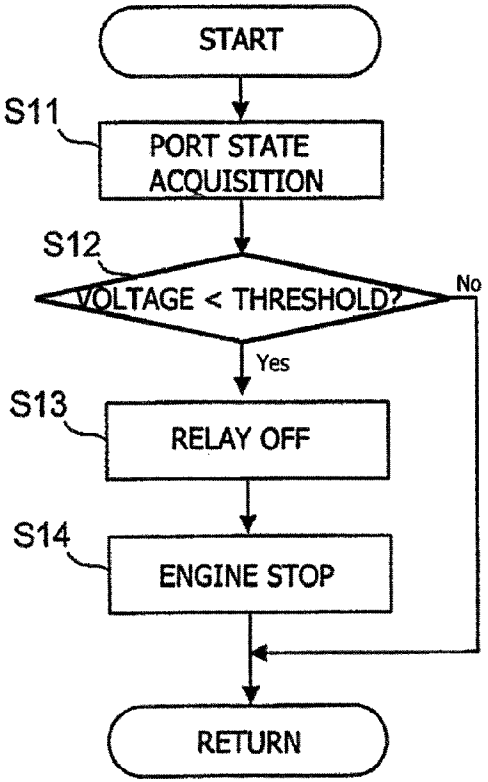
FIGS. 4(A) and 4(B) are flowcharts of processing examples executed by a control unit in the vehicle control device.
Figure 4A:
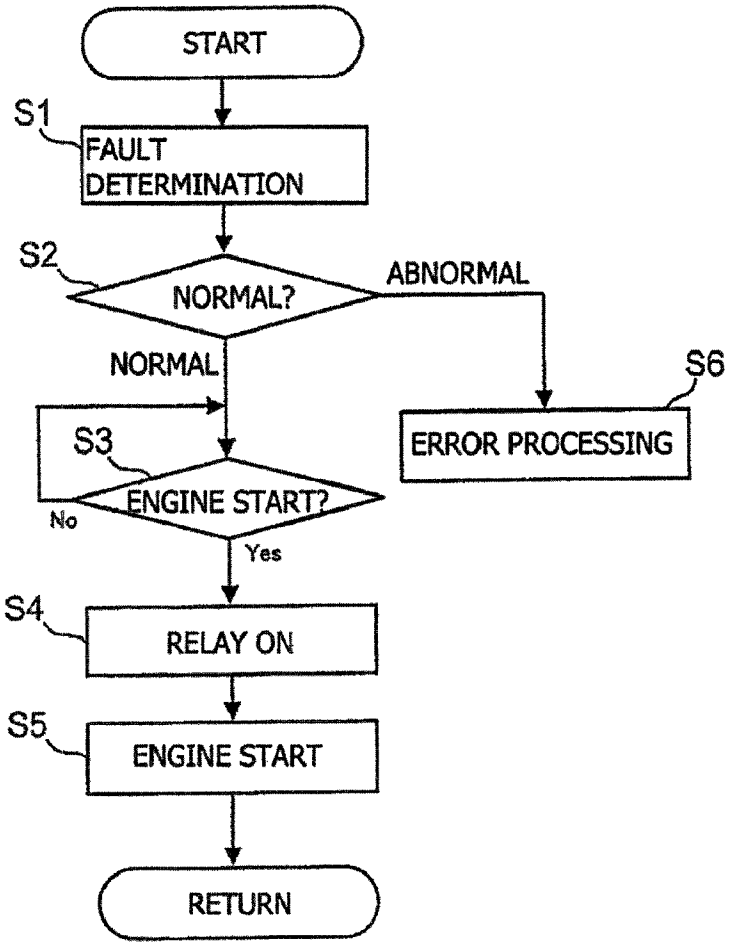

Next, examples of processing executed by the CPU of the microcomputer 31 will be described with reference to FIGS. 4(A) and 4(B). FIG. 4(A) shows a processing example when the vehicle 100 is powered on. FIG. 4(B) shows an example of determination processing that is executed during the period when the engine E is driven and is to determine whether or not the operation of the engine stop instruction switch 4 is made.

Referring to FIG. 4(A), processing of fault determination of external devices connected to the control unit 3 is executed in S1. Here, for example, a fault determination of the fuel injection device 5 and the ignition coil 6 is carried out. A publicly-known method can be employed as the method for the fault determination. Because the fuel injection device 5 and the ignition coil 6 are connected to the power source V on the upstream side of the engine stop instruction switch 4, the fault determination of the fuel injection device 5 and the ignition coil 6 is possible even when the engine stop instruction switch 4 is accidentally in the blocking state. A fault occurs in the electric pump 1 less frequently compared with the fuel injection device 5 and the ignition coil 6. Therefore, in the present embodiment, fault determination is not carried out for the electric pump 1. Alternatively, it is carried out after the relay 2 is switched on in S4, whereas the fault determination of the fuel injection device 5 and the ignition coil 6 is carried out at the initial stage.

If an abnormality is found in S2 as the result of the determination in S1, the processing proceeds to S6 and error processing is executed. If normality is confirmed, the processing proceeds to S3. In the error processing of S6, e.g. processing of informing the driver of the occurrence of a fault is executed.

In S3, it is determined whether or not an instruction to start the engine is given by operation of an engine start button or the like. If the instruction is given, the processing proceeds to S4. In S4, the relay 2 is switched on. More specifically, the drive part 34 is switched on to make a current flow through the coil part 2*b* of the relay 2 and close the contact part 2*a*. This actuates the electric pump 1. In S5, processing of starting the engine E is executed. Through the above, the processing of one unit ends.

Referring to FIG. 4(B), the state of the input port 31*d* (voltage measured by the A/D converter 31*e*) is acquired in S11. In S12, the voltage acquired in S11 is compared with a threshold voltage to determine whether or not operation of the engine stop instruction switch 4 is made. As the threshold voltage, a proper voltage value between the voltage that should be measured when the engine stop instruction switch 4 is in the conductive state and the voltage that should be measured when the engine stop instruction switch 4 is in the blocking state is set. By employing the determination method in which comparison with the threshold voltage is made, a determination as to the operation of the engine stop can be comparatively easily carried out.

In the case of the present embodiment, if the voltage acquired in S11 is lower than the threshold voltage, it is determined that the stop operation is made to the engine stop instruction switch 4 and the processing proceeds to S13. If not so, it is determined that the stop operation is not made and the processing of one unit is ended.

In S13, the relay 2 is switched off. More specifically, the drive part 34 is switched off to prevent a current from flowing through the coil part 2*b* of the relay 2 and open the contact part 2*a*. Although the relay 2 should be already in the off-state if the stop operation has been made to the engine stop instruction switch 4, the relay 2 is switched off in terms of the control. In S14, the engine E is stopped. For example, stopping of the driving of the fuel injection device 5, stopping of the driving of the ignition coil 6, and so forth are carried out. This stops the engine E. Through the above, the processing of one unit ends.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims

What is claimed is:

1. A vehicle control device for controlling a vehicle including an engine and an electric pump, the vehicle control device comprising:

a relay having a contact part for connecting and disconnecting a power source to and from the electric pump;

an engine stop instruction switch provided between the power source and a coil part of the relay for connecting and disconnecting the power source to and from the coil part; and a control unit for controlling the engine and the relay for determining whether or not an operation of the engine stop instruction switch is made;

wherein the control unit includes:

a port to which the coil part is connected;

a drive part connected to the port for switching current application of the coil part;

a detection part for detecting a current flowing to the port; and a determiner for determining whether or not the operation of the engine stop instruction switch is made based on a detection result of the detection part.

2. The vehicle control device according to claim 1, wherein the detection part includes an amplifier circuit for converting the current to a voltage to amplify the voltage and output the amplified voltage.

3. The vehicle control device according to claim 1, wherein:

a fuel injection device and an ignition coil of the engine are connected on a power supply line between the power source and the coil part and on an upstream side of the engine stop instruction switch; and the control unit carries out fault diagnosis of the fuel injection device when the vehicle is powered on.

4. The vehicle control device according to claim 2, wherein:

a fuel injection device and an ignition coil of the engine are connected on a power supply line between the power source and the coil part and on an upstream side of the engine stop instruction switch; and the control unit carries out fault diagnosis of the fuel injection device when the vehicle is powered on.

5. The vehicle control device according to claim 1, wherein the electric pump is a fuel pump for supplying fuel from a fuel tank to the engine.

6. The vehicle control device according to claim 2, wherein:

the detection part includes a shunt resistor connected to the drive part and through which a current flowing through the coil part flows; and the amplifier circuit is a differential amplifier circuit that includes an operational amplifier and amplifies a voltage across the shunt resistor.

7. The vehicle control device according to claim 6, wherein:

the drive part is a switching element; and the shunt resistor is provided between the switching element and GND.

8. The vehicle control device according to claim 2, wherein the determiner compares a voltage output from the detection part with a threshold to determine whether or not operation of the engine stop instruction switch is made.

9. The vehicle control device according to claim 3, wherein the ignition coil is connected to an output port of the control unit for igniting an air-fuel mixture in a combustion chamber of the engine.

10. The vehicle control device according to claim 1, wherein the engine stop instruction switch is set to a state wherein a contact part of the engine stop instruction switch is close in a normal conductive state and enters an open state wherein the contact part is opened when an operator of the vehicle actuates a stop condition.

11. A vehicle control device for controlling a vehicle comprising:

an engine;

an electric pump operatively connected to the engine;

a power source operatively connected to the electric pump;

a relay having a contact part for connecting and disconnecting the power source to and from the electric pump;

an engine stop instruction switch provided between the power source and a coil part of the relay for connecting and disconnecting the power source to and from the coil part; and a control unit for controlling the engine and the relay for determining whether or not an operation of the engine stop instruction switch is made;

said the control unit including a port for connecting the coil part, a drive part connected to the port for switching current application of the coil part, a detection part for detecting a current flowing to the port and a determiner for determining whether or not the operation of the engine stop instruction switch is made based on a detection result of the detection part.

12. The vehicle control device according to claim 11, wherein the detection part includes an amplifier circuit for converting the current to a voltage to amplify the voltage and output the amplified voltage.

13. The vehicle control device according to claim 11, wherein:

a fuel injection device and an ignition coil of the engine are connected on a power supply line between the power source and the coil part and on an upstream side of the engine stop instruction switch; and the control unit carries out fault diagnosis of the fuel injection device when the vehicle is powered on.

14. The vehicle control device according to claim 12, wherein:

a fuel injection device and an ignition coil of the engine are connected on a power supply line between the power source and the coil part and on an upstream side of the engine stop instruction switch; and the control unit carries out fault diagnosis of the fuel injection device when the vehicle is powered on.

15. The vehicle control device according to claim 11, wherein the electric pump is a fuel pump for supplying fuel from a fuel tank to the engine.

16. The vehicle control device according to claim 12, wherein:

the detection part includes a shunt resistor connected to the drive part and through which a current flowing through the coil part flows; and the amplifier circuit is a differential amplifier circuit that includes an operational amplifier and amplifies a voltage across the shunt resistor.

17. The vehicle control device according to claim 16, wherein:

the drive part is a switching element; and the shunt resistor is provided between the switching element and GND.

18. The vehicle control device according to claim 12, wherein the determiner compares a voltage output from the detection part with a threshold to determine whether or not operation of the engine stop instruction switch is made.

19. The vehicle control device according to claim 13, wherein the ignition coil is connected to an output port of the control unit for igniting an air-fuel mixture in a combustion chamber of the engine.

20. The vehicle control device according to claim 11, wherein the engine stop instruction switch is set to a state wherein a contact part of the engine stop instruction switch is close in a normal conductive state and enters an open state wherein the contact part is opened when an operator of the vehicle actuates a stop condition.

* * * * *